United States Patent [19]

Barthelmess

[11] Patent Number: 4,857,178

[45] Date of Patent: Aug. 15, 1989

[54] CENTRIFUGAL CLASSIFIER

[76] Inventor: Ulrich Barthelmess, Postfach 16, D 7908 Niederstotzingen, Fed. Rep. of Germany

[21] Appl. No.: 44,830

[22] Filed: May 1, 1987

[30] Foreign Application Priority Data

May 7, 1986 [DE] Fed. Rep. of Germany ..... 3615494

[51] Int. Cl.[4] ..... B07B 7/083

[52] U.S. Cl. ..... 209/143

[58] Field of Search ..... 209/144, 211, 289, 139.2, 209/143; 55/459.1, 459.2, 459.3, 459.4, 459.5; 210/512.3

[56] References Cited

U.S. PATENT DOCUMENTS 535,099 3/1895 Gale et al. ..... 209/144

2,953,307 9/1960 Lykken et al. ..... 209/144 X 2,973,094 2/1961 Lundy ..... 209/144

4,059,507 11/1977 Nobuo ..... 209/139.2

4,108,778 8/1978 Lambert et al. ..... 55/459.1

FOREIGN PATENT DOCUMENTS 1507729 3/1972 Fed. Rep. of Germany ... 209/139.2

*Primary Examiner*—Leonard E. Smith

*Attorney, Agent, or Firm*—Gilbert L. Wells

[57] ABSTRACT

A centrifugal classifier for classifying air, feed solids, fines and coarse particles has a housing with inlets and outlets. The housing is substantially parallelepipedic and contains a plurality of classifier rotors. Each rotor is connected to a separate outlet or to two separate outlets for classifying air and fines.

4 Claims, 8 Drawing Sheets

CENTRIFUGAL CLASSIFIER

This invention relates to a centrifugal classifier having a housing which is provided with inlets and outlets for classifying air, feed solids, fines and coarse particles. In the conventional classifiers the housing contains only one classifier wheel, which is provided at its periphery with the classifier blades (e.g., Published German Patent Application No. 16 07 631). Such classifiers have only a limited throughput rate. In order to increase the performance, a classifier rotor having classifier blades which have a multiple length has been accommodated in a classifier housing and has been provided at each end with an outlet for a mixture of fines and classifying air so that two or more classifiers are effectively combined. In that case the classifier blades may extend between two end rings, which are mounted in the end walls of the housing (German Patent Specification No. 28 25 400) or the classifier blades may be mounted by means of backing discs on a continuous shaft (German patent Specification No. 29 51 819). Whereas such classifiers will operate at a multiple throughput rate and a higher efficiency of separation, a given classifier of that type will effect a separation only at a single effective size during an operation at a given speed and a given air rate.

It is an object of the invention to provide a classifier which is capable of still higher performance and from which a plurality of particle fractions defined by different effective separating sizes can be withdrawn at the same time. The oversize content and the undersize content in each fine fraction should be minimized. That object can be accomplished by a substantially parallelepipedic housing containing a plurality of classifier rotors, each of which is connected to a separate outlet for classifying air and fines or to two separate outlets for classifying air and fines. In accordance with the invention a parallelepipedic housing contains a plurality of classifier rotors, from which respective fine fractions can be sucked.

A classifier rotor which succeeds another in the direction of flow preferably effects a separation at a larger size than the preceding rotor. Further features include the classifier rotors extending parallel to each other, two or more rows of juxtaposed classifier rotors arranged one over the other and the classifier rotors of each row laterally offset from the classifier rotors of another row.

Illustrative embodiments will now be described with reference to the drawing for explaing the invention in more detail.

Figure 1:
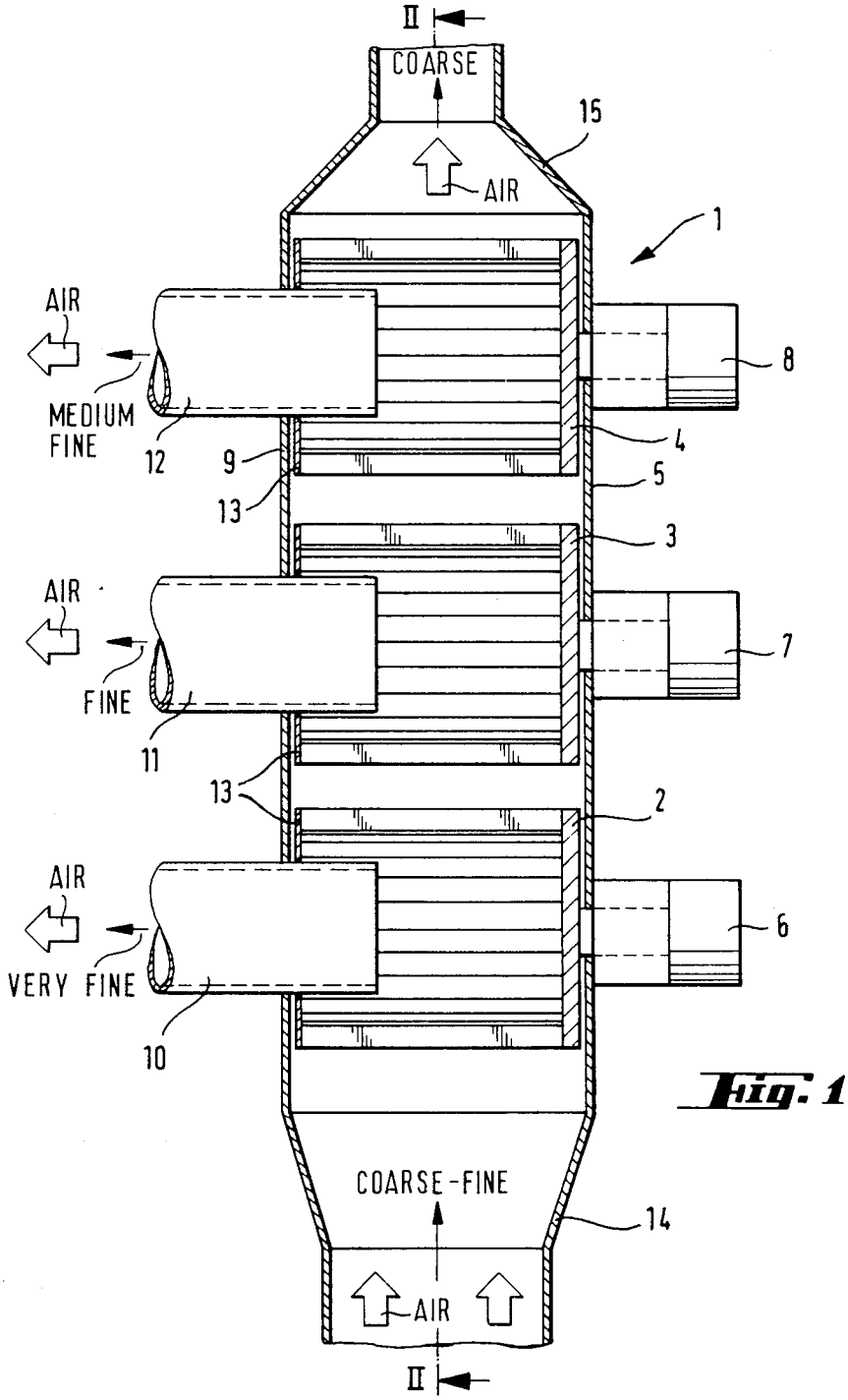
FIGS. 1 and 2 show a first illustrative embodiment in two sectional views taken at right angles to each other.
Figure 2:
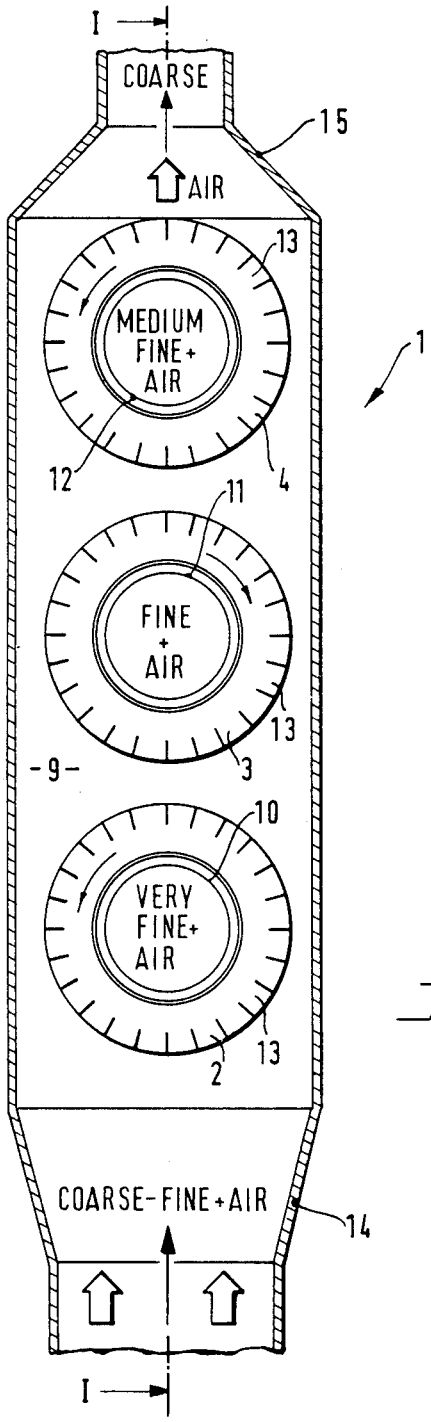

In accordance with FIGS. 1 and 2 an elongate box-shaped housing 1 contains three classifier rotors 2, 3, 4, which are known per se and disposed one over the other. The rotors are rotatably mounted on one wall 5 of the housing and are driven by separate drives 6, 7, 8. On the other side, a pipe extending through the side wall 9 of the housing is associated with each of the rotors 2, 3, 4 and protrudes into the interior of the associated rotor. As a result, each rotor is connected to a separate outlet 10, 11 or 12 for classifying air and fines. The blades of each rotor are interconnected at their free ends by a ring 13. The gap between the ring 13 and the wall 9 may be sealed by a labyrinth gland—with or without a supply of a rinsing fluid. A conical or funnel-shaped inlet 14 for classifying air and feed solids is provided at the lower end.

The classifier rotors 2, 3, 4 may effect a separation at different effective sizes and for this purpose may be driven at different speeds or may be operated with different suction pressures, or they may inherently effect a separation at different effective sizes (during an operation at the same speed and under the same suction pressure). In a preferred arrangement the lowermost classifier rotor 2 (which is the first in the direction of flow) effects a separation at the smallest effective size, the intermediate classifier rotor 3 effects a separation at an intermediate effective size, and the uppermost classifier rotor 4 (which is the third in the direction of flow) effects a separation at the largest effective size.

As a result, the finest fines will be sucked from the lowermost or first outlet 10, intermediate fines will be sucked from the intermediate outlet 11, and somewhat coarser fines will be sucked from the upper outlet 12, in each case together with classifying air. A remaining part of the classifying air together with relatively coarse solids still contained in that air are sucked through a tubular port 15, which is attached at the top. The air streams are indicated by broad arrows and the solids streams by narrow arrows.

From the feed solids introduced at the bottom, the smallest particle size fraction is removed by means of the lowermost classifier rotor 2 so that said smallest particle size fraction is no longer present above the lowermost rotor 2. Analogous remarks are applicable to the intermediate and uppermost classifier rotors 3, 4.

A plurality of particle fractions are obtained with a very "steep" particle distribution, i.e., with a very small content of oversize and a very small content of undersize.

Figure 3:
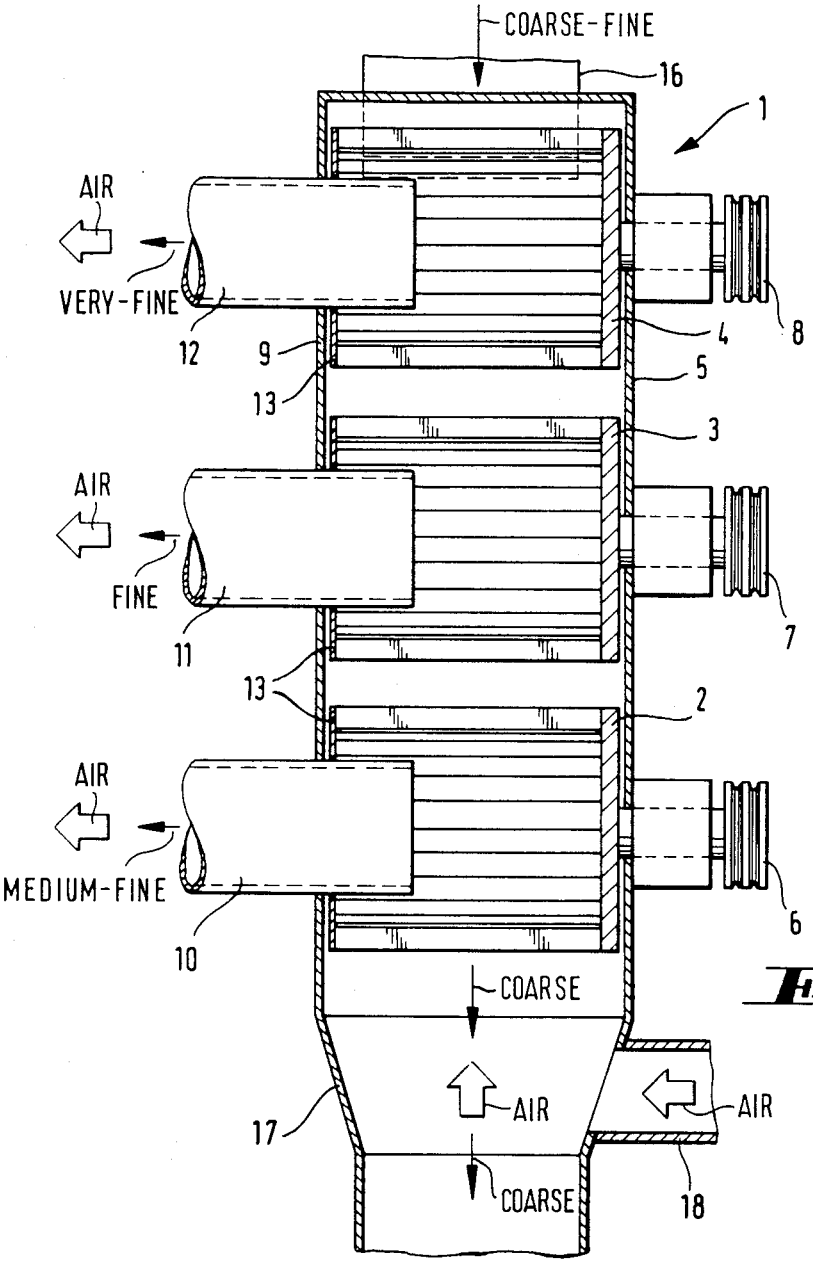
FIGS. 3 and 4 show a second illustrative embodiment.
Figure 4:
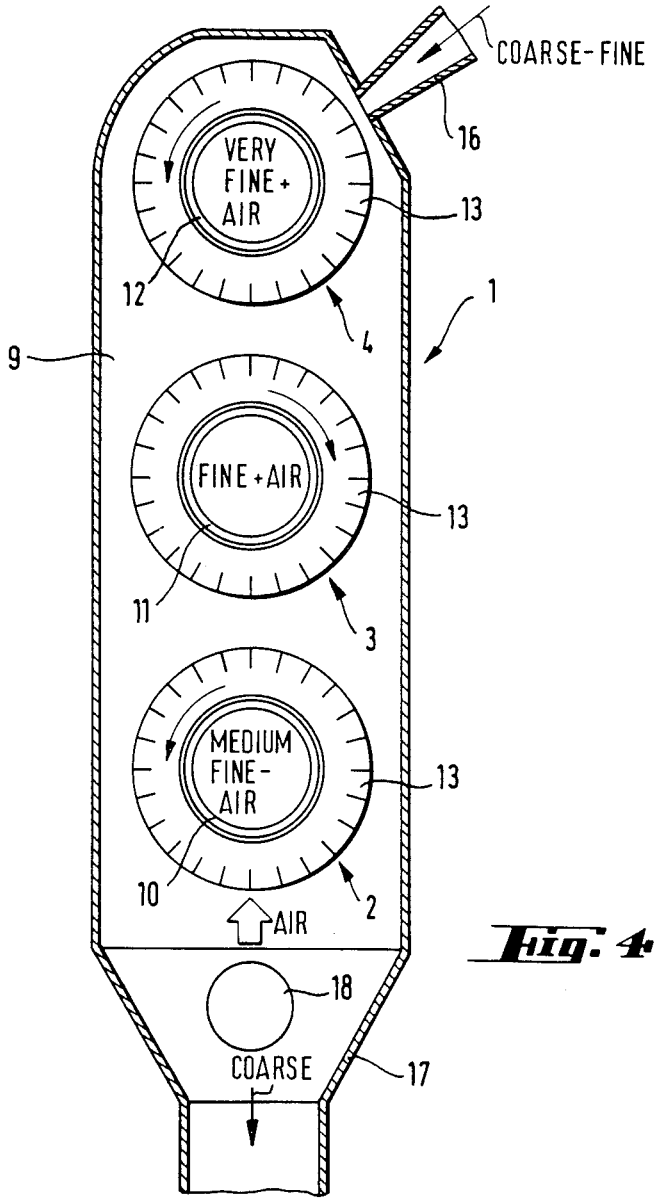

The embodiment shown in FIGS. 3 and 4 is similar to the one shown in FIGS. 1 and 2 (like parts are designated with the same reference characters) but differs from it that the mixed particles to be classified into a plurality of particle fractions are supplied to the classifier housing 1 through an inlet 16 that is laterally disposed near the top and a funnel-shaped outlet 17 for coarse particles is provided at the bottom and is provided with a laterally disposed inlet 18 for classifying air.

That embodiment is intended for classifying coarser feed solids so that the coarsest would be too large to be entrained by a stream of classifying air.

In addition to the fact that the feed solids are divided into more than two particle fractions, the classifier has a higher efficiency. This is due to the fact that the classifier rotors are relatively closely spaced apart so that they influence each other and, specifically, particles sticking together will be separated (desagglomerated). The classifier rotors may rotate in the same sence or in opposite senses.

The throughput rate is also increased.

The classifier rotors may optionally be operated at the same speed for a separation at the same effective size if it is sufficient to obtain a higher throughput rate, i.e., when feed solids are to be divided into two particle fractions at a high rate.

Figure 5:
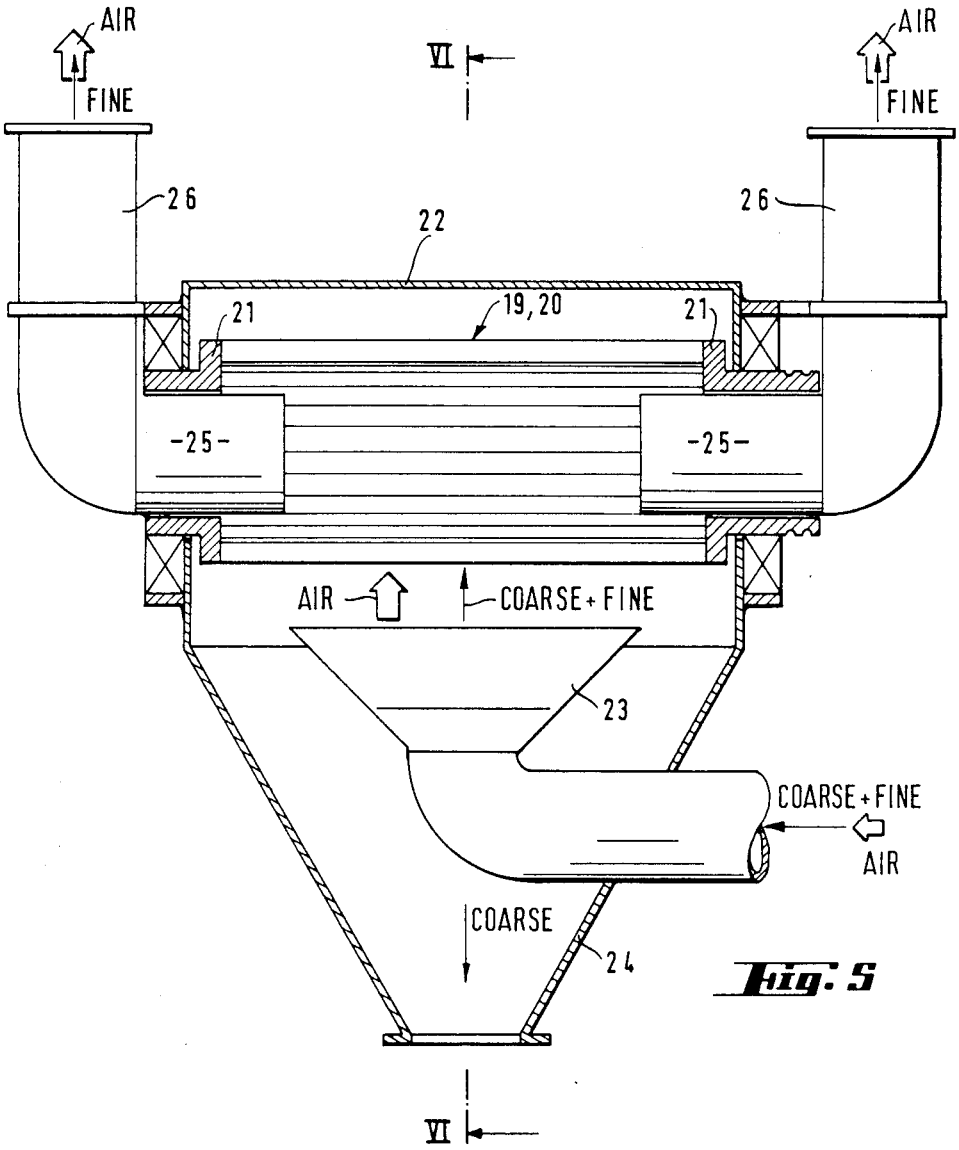
FIGS. 5 and 6 show a third illustrative embodiment.
Figure 6:
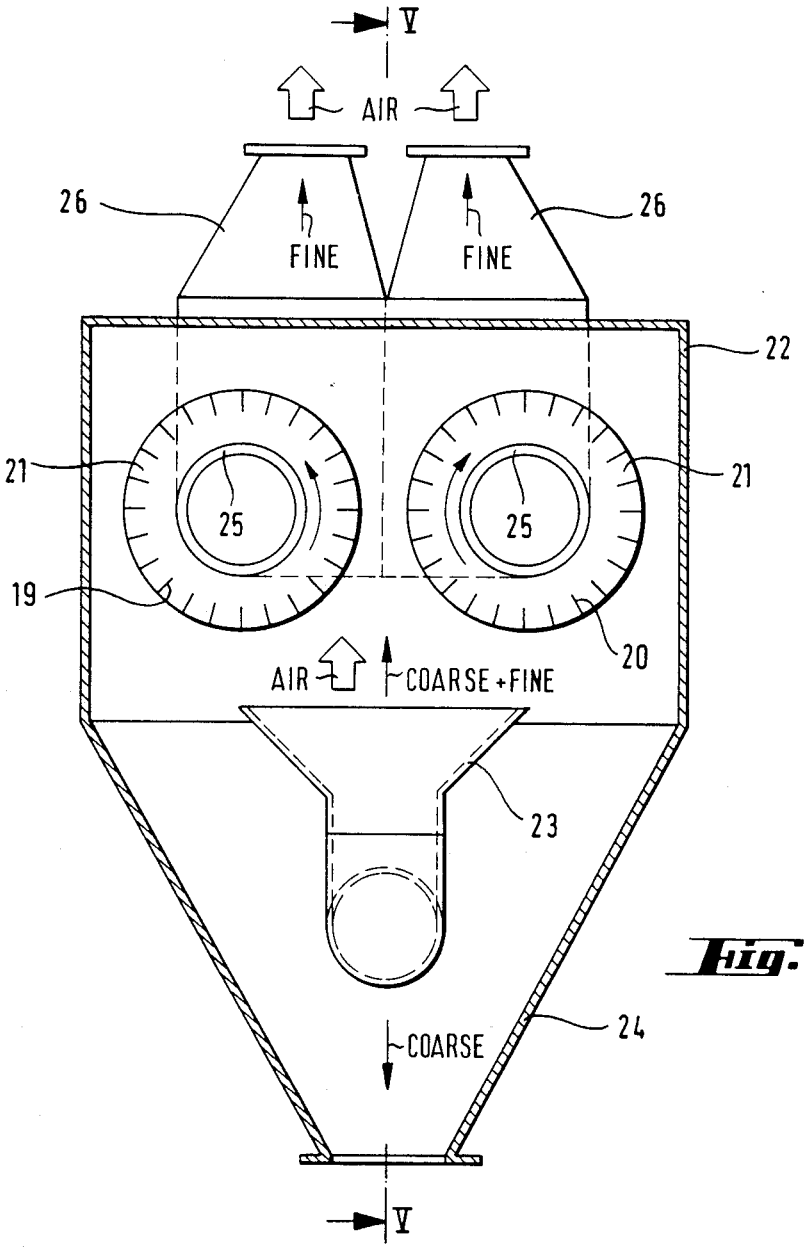

The embodiment shown in FIGS. 5 and 6 is particularly intended for a high performance. For this purpose, the fines are sucked from both ends of each of the classifier rotors 19, 20, which have a multiple length for achieving a correspondingly higher performance.

The classifier blades extend between rings 21, which are mounted in the housing 22 at both ends. Each ring 21 receives a protruding piipe 25, which is connected on the outside to a separate discharge duct 26, which extends upwardly in that case. One of the end rings 21 is driven, in FIG. 5 by vee belts.

More than two classifier rotors 19, 20 may be provided, from which the fines are sucked at both ends of each rotor. In a practicable arrangement, e.g., three rotors are horizontally juxtaposed or are arranged in a triangular array or four rotors may be arranged in a quadrangular array.

A guide 23 for a mixture of feed solids and air is disposed below the rotors and is symmetric to them and flares like a funnel. As a result, said mixture is uniformly supplied to both classifier rotors 19, 20 throughout their length. The coarsest are withdrawn through a funnel-shaped extension 24 at the bottom of the housing.

It may be mentioned that in the embodiment shown in FIGS. 1 to 4 the classifier rotors from which the fines are sucked at one end may be replaced by classifier rotors from which the fines are sucked at both ends if a correspondingly high performance is required.

Figure 7:
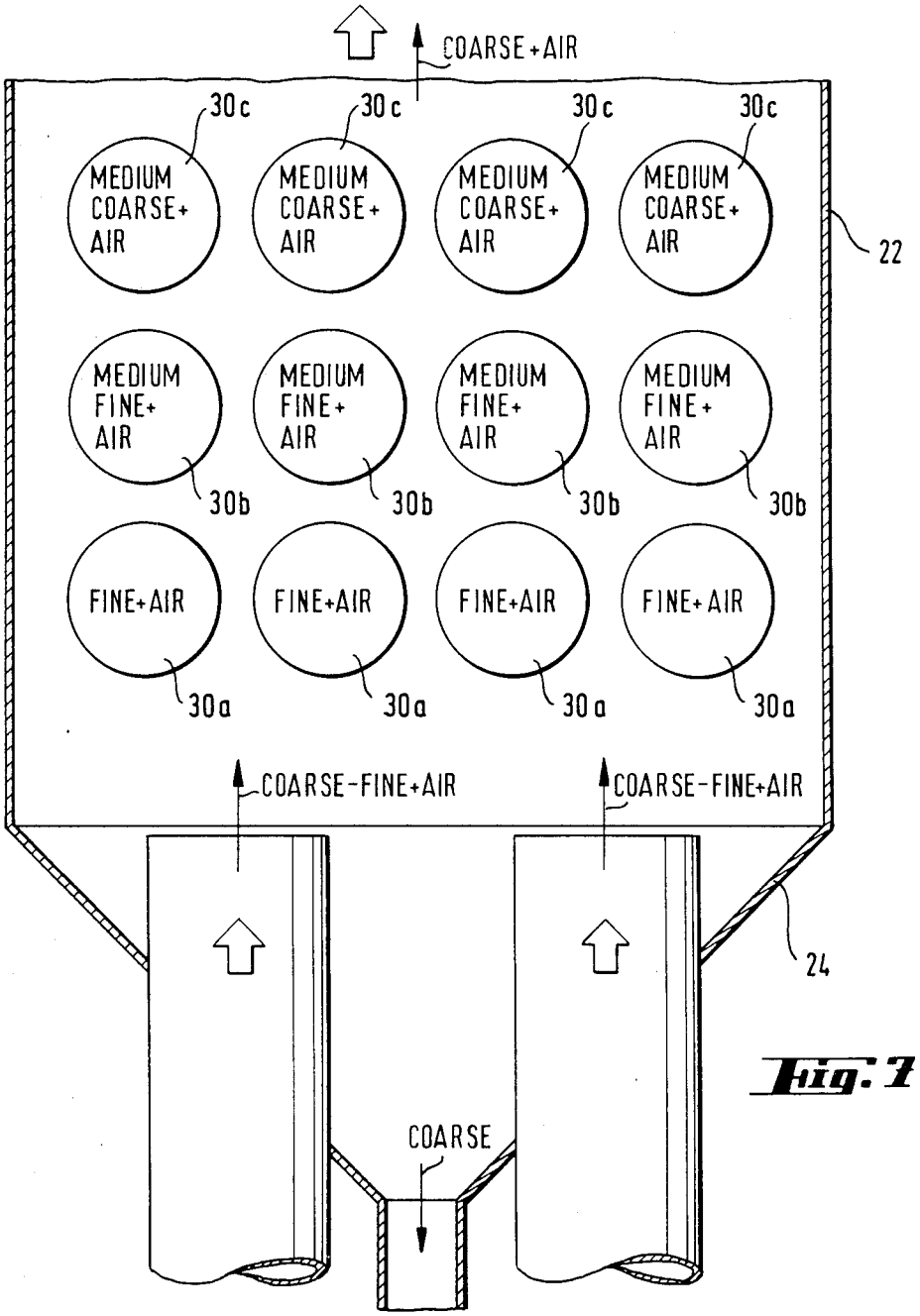
FIG. 7 is a vertical transverse sectional view showing a fourth illustrative embodiment.

In the embodiment shown in FIG. 7 the classifier rotors are arranged in three rows consisting of four superimposed rotors, 30*a, b, c* each. The rotors 30*a* of the lowermost row effect a separation at the smallest effective size. The rotors 30*c* of the uppermost row effect a separation at a larger effective size. In a view from the side that arrangement corresponds to that shown in FIG. 1. Just as in FIG. 1, a plurality of fine fractions are obtained but at a four times higher rate.

The mixture of feed solids and air is introduced into the housing 22 at its bottom through pipes. Coarse particles are discharged through a funnel-shaped bottom part 24 of the housing.

Figure 8:
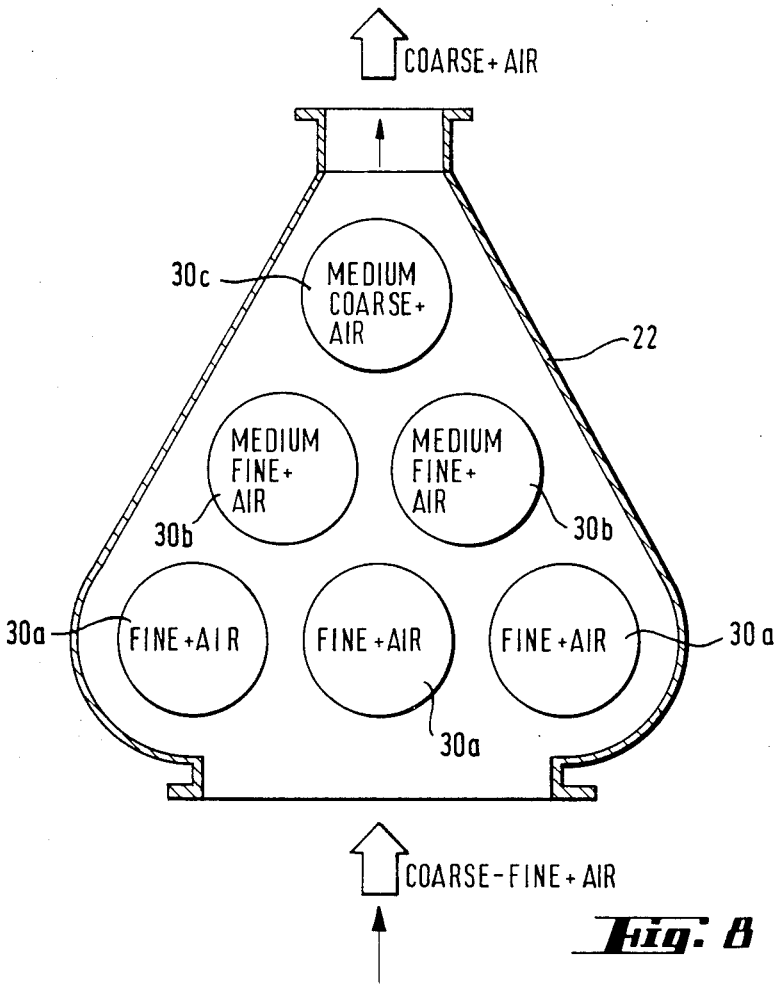
FIG. 8 shows a fifth illustrative embodiment.

The embodiment shown in FIG. 8 comprises three juxtaposed rotors 30*a* on a lower level, two rotors 30*b* over and between the rotors 30*a*, and a single rotor 30*c* over and between rotors 30*b*. Fine fines are withdrawn from the lowermost rotors 30*a*. Intermediate fines are withdrawn from the intermediate rotors. Relatively coarse fines are withdrawn from the uppermost rotor 30*c*. That arrangement allows for the fact that the rate of the mixture of feed solids and air progressively decreases in an upward direction (in the direction of flow) so that the required throughput rate of the classifier decreases in an upward direction. In that embodiment the mutual influence of the rotors is particularly strong.

This result can be increased further and an improved utilization of space can be achieved if classifier rotors which are smaller in diameter are disposed between classifier rotors which are relatively large in diameter.

I claim:

1. A centrifugal classifier for classifying air, feed solids, fines and coarse particles, comprising:

(a) a substantially parallelepipedic housing;

(b) inlet means in said housing for said air and feed solids;

(c) a plurality of outlets in said housing for said fines and coarse particles;

(d) a plurality of classifier rotors mounted in said housing parallel to one another and each of said rotors connected to a separate one of said outlets; and (e) a plurality of drives each of which is connected to one of said rotors.

2. The centrifugal classifier of claim 1, wherein there are three classifier rotors and three connected drives.

3. The centrifugal classifier of claim 1, wherein at least two rows of juxtaposed classifier rotors are arranged one over the other in said housing.

4. The centrifugal classifier of claim 3, wherein said classifier rotors of each row are laterally offset from classifier rotors of another row.

* * * * *